US005956541A

United States Patent [19]

Hoshika et al.

[11] Patent Number: 5,956,541

[45] **Date of Patent: *Sep. 21, 1999**

[54] CONTROLLING IMAGE FORMATION BASED ON AMOUNT OF DEVELOPER RECOVERED

[75] Inventors: Norihisa Hoshika; Satoshi Tsuruya, both of Mishima, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/900,644

[22] Filed: Jul. 25, 1997

[30] Foreign Application Priority Data

Jul. 26, 1996 [JP] Japan ..... 8-215192

[51] Int. Cl.[6] ..... G03G 15/00

[52] U.S. Cl. ..... 399/24; 399/25; 399/81

[58] Field of Search ..... 399/29, 30, 43, 399/61, 64, 34, 35, 24, 27, 81, 25

[56] References Cited

U.S. PATENT DOCUMENTS

| | | | |
|---|---|---|---|
| 4,687,320 | 8/1987 | Nakanishi et al. | 399/35 |
| 5,105,219 | 4/1992 | Yoshikado | 399/43 X |
| 5,160,966 | 11/1992 | Shiina et al. | 399/27 |
| 5,500,716 | 3/1996 | Morishita et al. | 399/35 |
| 5,682,574 | 10/1997 | Oshida et al. | 399/64 |
| 5,708,912 | 1/1998 | Lee | 399/24 |
| 5,717,974 | 2/1998 | Park | 399/24 |
| 5,812,902 | 9/1998 | Lee | 399/25 |

FOREIGN PATENT DOCUMENTS

| | | |
|---|---|---|
| 63-212956 | 9/1988 | Japan . |
| 3-230172 | 10/1991 | Japan . |

*Primary Examiner*—S. Lee

*Attorney, Agent, or Firm*—Fitzpatrick, Cella, Harper & Scinto

[57] ABSTRACT

An image forming apparatus has an image bearing member, a developing agent image formed on the image bearing member, and transferring device for transferring the developing agent image onto a recording member. The image bearing member is cleaned, and the developing agent removed therefrom is stored in a container. A detection is performed as to whether or not the quantity of developing agent in the container has reached a predetermined state, and once the result of such detection becomes positive, the number of prints made thereafter is counted. The result of the detection and the result of the count are stored in a memory along with the container, and the image forming operation is controlled in accordance with the stored information. In another embodiment, the memory is stored in an attachable cartridge. The attachable cartridge has an image bearing member, a charger, a developing device, and a cleaning device.

15 Claims, 6 Drawing Sheets

CONTROLLING IMAGE FORMATION BASED ON AMOUNT OF DEVELOPER RECOVERED

BACKGROUND OF THE INVENTION

1. Field of the Invention

The present invention relates to an image forming apparatus such as a copying machine and a printer, and also to a cartridge.

2. Related Background Art

An image forming apparatus that has hitherto used an electrophotographic image forming process, involves adopting a process cartridge system, therein an electrophotographic photosensitive member and a process means acting on the electrophotographic photosensitive member are formed integrally into a cartridge which is set detachable from and attachable to a main body of the image forming apparatus. According to this process cartridge system, the user himself or herself is able to conduct maintenance of the apparatus without calling a service person, and therefore operability can be by far more enhanced than ever. This being the case, the process cartridge system is widely used in the image forming apparatus.

The image forming apparatus of this cartridge system requires a device for notifying the user of when the cartridge should be exchanged because the user himself or herself is to exchange the cartridge.

As a device for detecting a life-span of the cartridge, there has hitherto been proposed a method by which a non-volatile memory means such as an EEPROM is utilized for storing an integrated using quantity of the cartridge. Proposed in, for example, Japanese Patent Application Laid-Open No. 63-212956 is an electrophotographic image forming apparatus constructed such that a cartridge incorporates a memory classified as a non-volatile memory means as described above, a main body has a device for executing reading and writing processes from and to the memory, information on a life-span of the cartridge is calculated based on a content read from the memory and on an electrophotographic operation, and this item of information is written to the memory.

Proposed further in Japanese Patent Application Laid-Open No. 3-230172 is an image forming apparatus in which a non-volatile storage medium provided in an exchange unit stores characteristic information of the unit and a quantity with which the unit is used.

There arise, however, the following problems inherent in the above methods of detecting the life-span of the parts and detecting a quantity of the toners consumed.

According to the methods stated in Japanese Patent Application Laid-Open Nos. 63-212956 and 3-230172, the information for detecting the life-span of the photosensitive body involves the use of the number of prints with which the cartridge is used, and information on the integration of the number of rotations of the photosensitive drum. These items of information are comparatively well coincident with the life-spans of the respective parts constituting the cartridge, but insufficient in terms of accuracy for determining the life-span of the cartridge for the reason which follows. To be specific, the number of prints and the number of rotations of the photosensitive drum have a correlation with an abrasion/fatigue of the photosensitive drum, which is one of determinants of the life-span of the process cartridge. No consideration is, however, given to a quantity of disposal toners collected by the cleaner, which is another determinant of the life-span. Therefore, if a container becomes full of the disposal toners removed by the cleaners before reaching the life-span conditioned by the abrasion of the photosensitive drum, there must be caused critical damage to the main body of the apparatus, such as, e.g., a breakage of a drive gear due to an increase in torque of the process cartridge and a wide intra-machine scatter of the disposal toners when leaking out of the collecting container.

Moreover, the full storage of the disposal toners is detected by the main body of the apparatus, from which time the number of printable sheets is displayed, and, even in such a case, it is impossible to precisely display the number of remaining printable sheets, viz., how many sheets can be printed later on when the user detaches and attaches the process cartridge thereto or to a main body of other apparatus on such an occasion that the memory of the main body of the apparatus is stored with information showing the container becoming full of the disposal toners and information indicating the number of remaining printable sheets.

SUMMARY OF THE INVENTION

It is a primary object of the present invention, which was contrived to obviate the problems given above, to provide a cartridge capable of accurately detecting a life-span of the cartridge from disposal toners and the number of remaining printable sheets when normally attaching and detaching the cartridge or attaching this cartridge to a main body of other apparatus, and of notifying a user of it, and also an image forming apparatus from which the cartridge is attachable and detachable.

To accomplish the above object, according to one aspect of the present invention, an image forming apparatus comprises an image bearing member, an image forming device for forming an image of developing agent on the image bearing member, a transferring device for transferring the developing agent image formed on the image bearing member onto a recording member, a cleaning device for cleaning the image bearing member, a container for storing the developing agent removed from the image bearing member, a detecting device for detecting whether or not a quantity of the developing agent in the container reaches a predetermined state, a counting device for counting the number of prints after the quantity of the developing agent in the container has reached the predetermined state, a storing device for storing a result of detection by the detecting device and a count value by the counting device, and a control device for controlling the apparatus in accordance with the information stored in the storing device.

According to another aspect of the present invention, a cartridge comprises a container for storing the developing agent collected from the image bearing member, and a storing device for storing information for judging whether or not a quantity of developing agent within the container reaches a predetermined state, and the number of prints after the quantity of developing agent within the container has reached the predetermined state.

Further objects of the present invention will become apparent from a detailed description which follows with reference to the accompanying drawings.

DETAILED DESCRIPTION OF THE PREFERRED EMBODIMENTS

An image forming apparatus and a process cartridge according to the present invention will hereinafter be described in greater detail with reference to the drawings.

Embodiment 1

Figure 1:
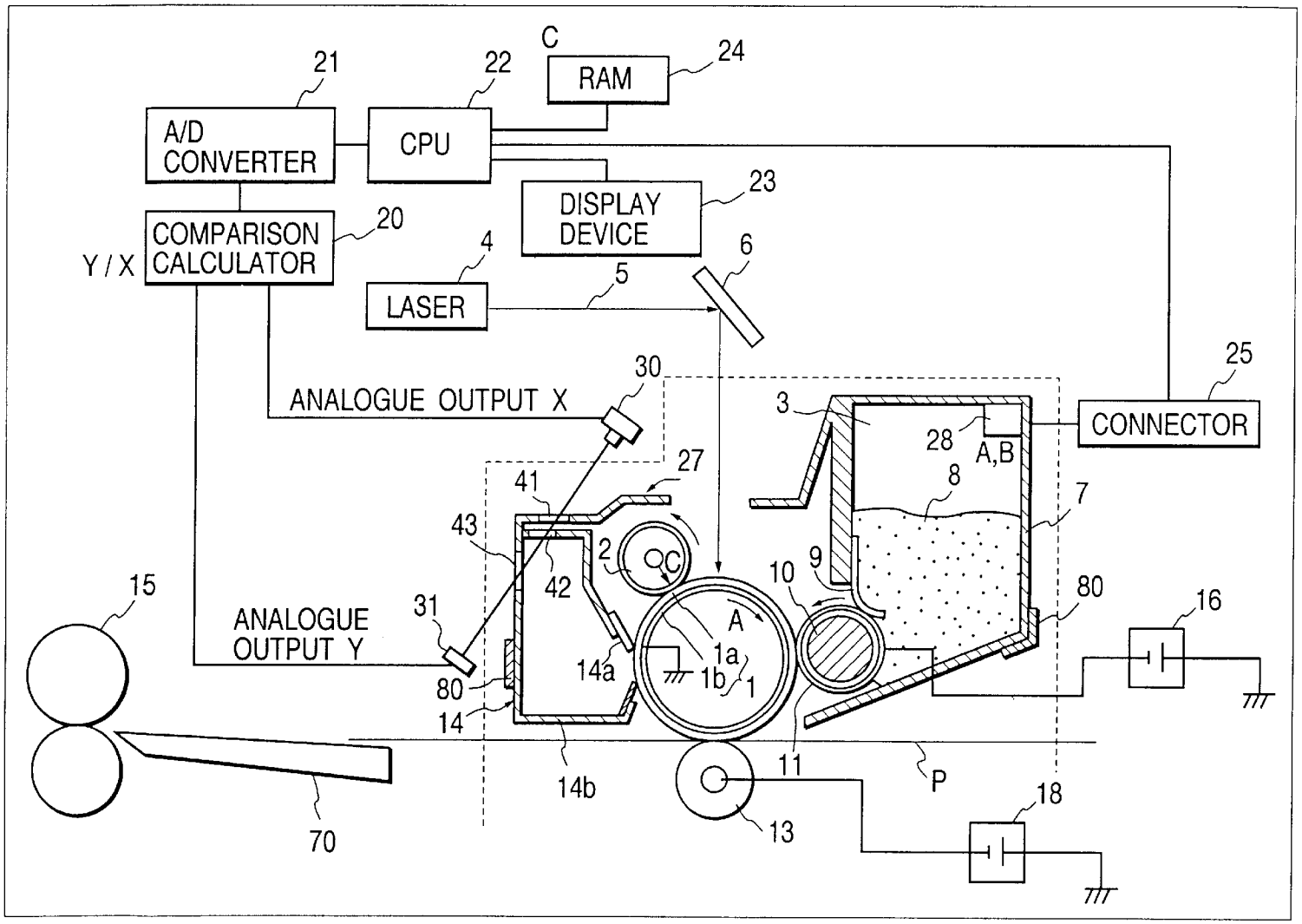
FIG. 1 is a view schematically showing a construction of an image forming apparatus in an embodiment 1 of the present invention.
Figure 2:
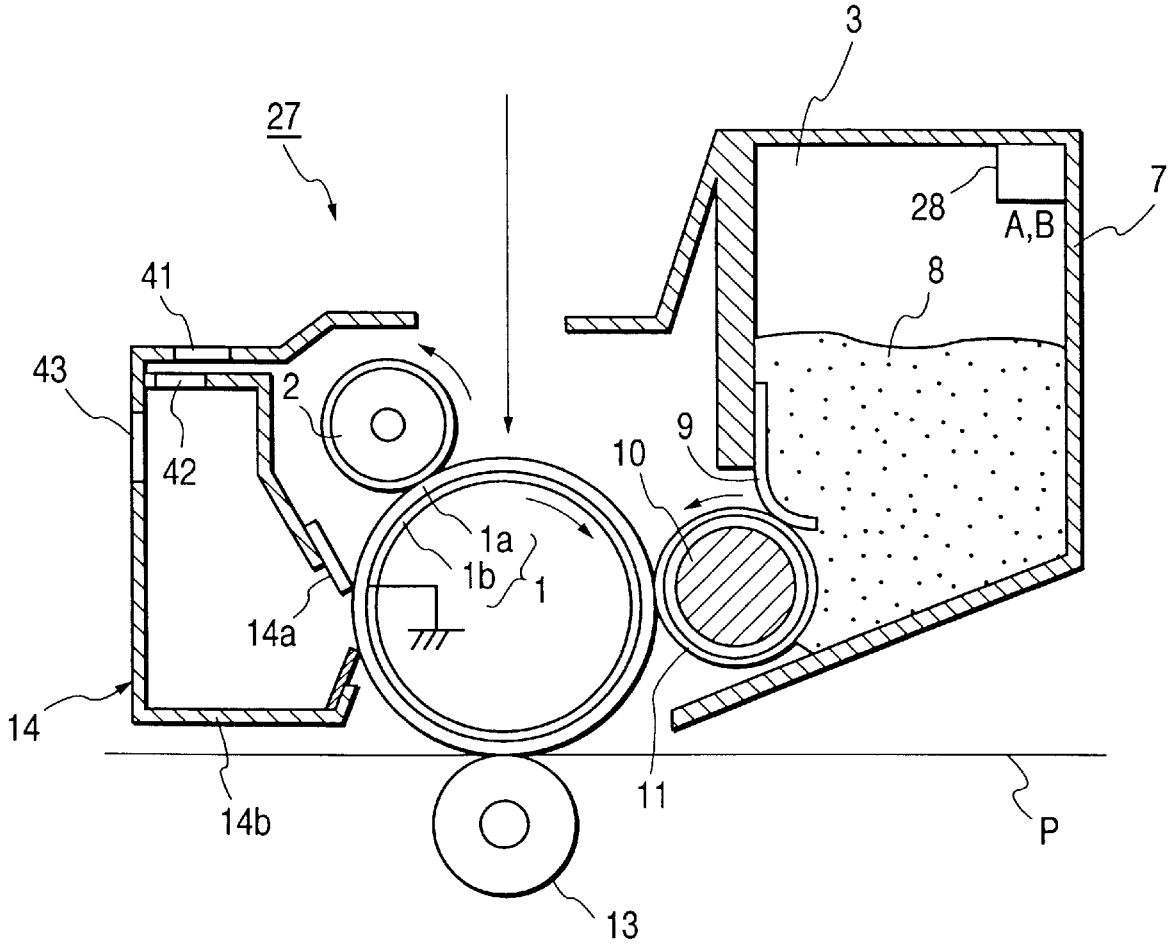
FIG. 2 is a view illustrating a process cartridge attached to the image forming apparatus shown in FIG. 1.

An embodiment of the present invention will be discussed with reference to FIGS. 1 to 3. A printer (LBP) for executing an exposure process by use of laser beams is shown in FIG. 1 by way of an image forming apparatus. The printer is constructed of an electrophotographic photosensitive body defined as a photosensitive drum, charging rollers 2, a developing device 7, a process cartridge 27 incorporating a process mechanism of a cleaning device 14, transfer rollers 13, a fixing device 15, a laser scanner 4 serving as an optical system, and a mirror 6. Note that the process cartridge 27 is exchangeably attached to a main body.

The following is an explanation of an image forming process of this printer.

The photosensitive body 1 is 30 mm in major diameter and constructed by laminating a photosensitive layer 1*a* exhibiting a photo conductivity on the surface of a conductive substrate 1*b* composed of aluminum. The photosensitive body 1 is rotationally driven at a peripheral speed on the order of 100 mm/sec in an arrowed direction A in FIG. 1. Further, the photosensitive body 1 is subjected to uniform charging of a negative polarity by the charging rollers 2. Subsequently, the photosensitive body 1 is scan-exposed with a resolution on the order or 600 dpi to exposure laser beams 5 corresponding to time series electric digital image signals of image data transmitted from a video controller (not shown), which beams are outputted from a laser scanner 4. An electrostatic latent image is thereby formed on the surface via the mirror 6 provided in the main body of the image forming apparatus.

The electrostatic latent image on the photosensitive body 1 is inversion-developed with toners 8 borne on a developing sleeve 11 in the developing device 7 and thus sensitized as a toner image, and this toner image is transferred onto a sheet of transfer sheet P by the transfer rollers 13. Then, the transfer sheet P onto which the toner image has been transferred is separated from the photosensitive body 1 and guide to the fixing device 15 through a convey mechanism 70. The toner image is fixed by the fixing device 15 and thereafter discharged out of the main body of the image forming apparatus. The photosensitive body 1 after going through the transfer process is cleaned of the residual toners thereon by the cleaning device 14, and the photosensitive body 1 will be again in the charging process.

By the way, the developing device 7 adopts a non-contact developing method and includes the developing sleeve 11 defined as a rotatably supported toner bearing body for bearing the toners 8 and conveying them to the photosensitive body 1, a magnetic field generating unit 10 fixed within the developing sleeve 11, and a toner storage chamber 3. The developing sleeve 11 is connected to a power supply 16 capable of applying an AC bias and a DC bias, and, in accordance with the first embodiment, a DC component of −500 V is overlapped with a rectangular wave of a peak-to-peak voltage on the order of 1200 V and then applied thereto.

A doctor blade 9 for regulating a layer thickness of the toners 8 on the developing sleeve 11 is composed of polyurethane rubber, and has a hardness of 67° on JISA and a thickness of 1.1 mm. The toners 8 are, when the developing bias is applied to the developing sleeve 11, coated as a thin layer over the developing sleeve 11 and developed on the photosensitive body 1 at a face-to-face portion to the photosensitive body 1. In accordance with the first embodiment, the toners 8 involve the use of magnetic one component toners and are stored in the toner storage chamber 3.

The charging roller 2 is 6 mm in diameter of a core bar, 12 mm in major diameter of the roller and approximately 220 mm in roller length. Further, both ends of the core bar are each pressurized at 500 gf in an arrowed direction C in FIG. 1 and contiguous to the photosensitive body 1 with a nip on the order of 1.5 mm. The charging rollers 2 are constructed not to be driven but to rotationally follow the photosensitive body 1. Further, the charging roller 2 is connected via the core bar to a primary bias applying power supply (not shown). In the first embodiment, a bias obtained by overlapping a DC bias of −600 V with an AC bias (a peak-to-peak voltage: 1600 V, a frequency: 1000 Hz, and a sine wave), is applied to the charging roller 2, thereby charging the surface of the photosensitive body 1 uniformly with approximately −580 V.

The cleaning device 14 includes a cleaning blade 14*a* for cleaning the photosensitive body 1 of the residual toners thereon, and a storage container 14*b* for storing the disposal toners of which the blade 14*a* has cleaned the photosensitive body 1. The main body of the apparatus incorporates a light emitting element 30 for emitting the light beams so as to penetrate an upper angular portion of the cleaning device 14, and a light receiving element 31 for receiving the light beams. The cleaning device 14 is provided with light transmissive windows 41, 42 and 43 on an optical path thereof. Then, the light receiving element 31 receives a sufficient quantity of light beams in a state where the interior of the cleaning device 14 is not full of the disposal toners.

Moreover, the developing device 7 of the process cartridge 27 is provided with a memory 28 serving as a storage device, and is electrically connected to the main body of the apparatus through a connector 25 thereof, so that the data can be transmitted to and received from a CPU 22 of the main body. Namely, the CPU 22 of the main body is capable of reading and writing the data. Further, the CPU 22 is connected to a RAM 24 stored with respectively necessary items of data.

Output voltages of the light emitting element 30 and of the light receiving element 31 are inputted to a comparison calculator 20 within the main body, and the comparison calculator 20 executes a comparative calculating process on values of these two output voltages. A result of calculation is digitized by an A/D converter 21 and thereafter taken in by the CPU 22 at a proper timing.

Figure 3:
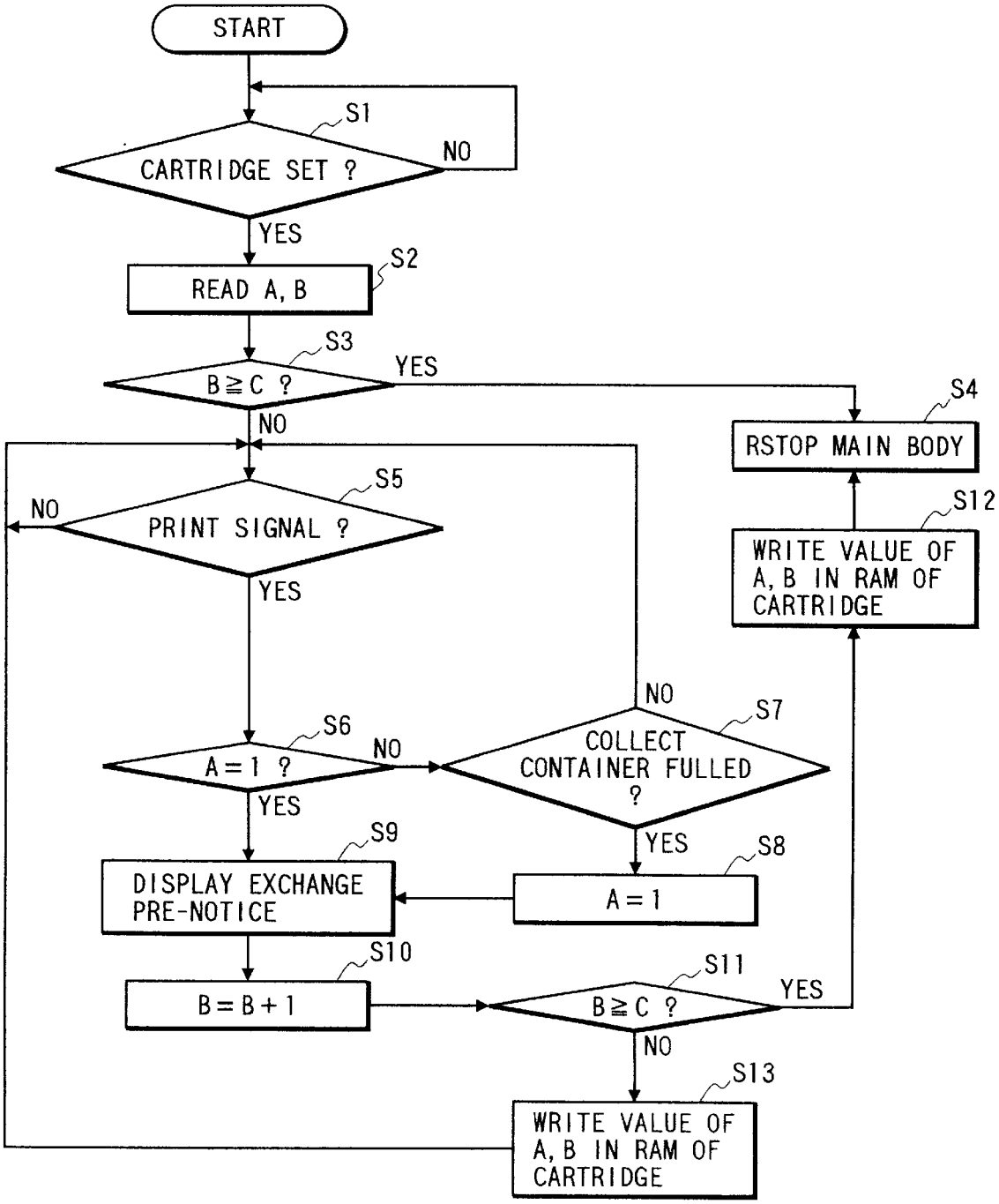
FIG. 3 is a flowchart showing procedures of detecting a life-span thereof in the embodiment 1.

Next, a detection of a life-span of the process cartridge defined as a characteristic portion of the present invention will be explained with reference to a flowchart of FIG. 3 showing procedures of detecting the life-span thereof in the first embodiment.

Confirmed in step S1 is a setting state of whether the process cartridge 22 is correctly attached to the main body of the image forming apparatus, and, if the cartridge is attached thereto, the processing proceeds to step S2. In step S2, the CPU 22 of the main body has an access to the memory 28 incorporated into the process cartridge 27 via the connector 25. The memory 28 is stored with data A indicating whether or not a full storage of the present cartridge itself was detected in the past by the main body, and data B indicating the number of prints printed after the detection of the full storage. In accordance with the first embodiment, the data A is 1-bit data and takes a value of "0" if the full storage was not detected in the past and a value of "1" if detected in the past.

Note that the state of full storage described herein is a state where the light beams emitted from the light emitting element 30 are intercepted by the disposal toners collected into the container 14*b* and therefore do not reach the light receiving element 31, but is not necessarily a state where the container 14*b* is stored 100% with the disposal toners. In general, some space is left in the container 14*b* even in the state where the light beams do not reach the light receiving element. In the first embodiment also, such a state is defined as a full storage state.

In the first embodiment, the 1-bit data is used as the data indicating whether the full storage state is detected or not. Data of a plurality of bits may also be used for indicating detailed states of the full storage of the collecting container. A new process cartridge 27 is stored with values of A=0 and B=0, and, in this step S2, the CPU 22 reads these pieces of data A and B.

In next step S3, a number of residual printable sheets C (a predetermined number of prints) that is previously stored in the RAM 24 in the main body, is compared with a number of prints B printed after detecting the full storage read in step S2. If a value B is over a value C, the full storage state of this cartridge has already been detected, and the number of prints thereafter reached the predetermined number of prints, which implies that if more printed than this, there is a possibility in which the main body might suffer from a critical damage. Hence, if the value B exceeds the value C, the processing proceeds to next step S4, wherein the main body is stopped. Herein, the "stoppage of the main body" in the first embodiment connotes a state of not accepting the input of the print signal, and also a state where printer engines for image forming portions (an image writing portion and a developing portion) and a sheet feeding mechanism are stopped, but the main power supply is kept ON. After stopping the main body, a display device 23 may display for the user that the predetermined number of prints in this cartridge is exceeded to reach its life-span, and that the main body does not operate unless it is exchanged.

In step S3, if the value B is less than the value C, the main body does not yet suffer from the critical damage even when permitting the printing, and therefore the printing is allowed, thus coming to a wait for print signal status (step S5).

Next, when the print signal is turned ON, the main body of the image forming apparatus starts printing, and the processing goes forward to step S6. It is judged in step S6 whether the data A indicating whether or not the full storage of the present cartridge itself was detected in the past by the main body, is "1" or not. If A=1, this purports that the full storage was detected in the past by the main body. If A=0, this purports that the full storage was not detected in the past by the main body. Thus, when A=0, the processing proceeds to step S7, wherein it is checked whether or not the collecting container is full of the toners. More specifically, an output voltage X of the light emitting element 30 stated above and an output voltage Y of the light receiving element 31, are inputted to the comparison calculator 20 in the main body, in which the values of two voltages are compared and calculated. An arithmetic result is digitized by the A/D converter 21 and thereafter taken in by the CPU 22.

The CPU 22 is capable of reading a value (Y/X) after the A/D conversion has been made. If the value given by Y/X is approximate to "1", there is no full storage. If approximate to "0", this implies that the light beams from the light emitting element do not sufficiently reach the light receiving element 31 because of the existence of the disposal toners, and it can be therefore regarded vicinal to the full storage. If the value (Y/X) after the A/D conversion is smaller than a predetermined value, it is judged that the full storage is attained, and the processing proceeds to step S8 in which to set the value A to "1". Thereafter, the processing goes forward to step S9. If the value (Y/X) after the A/D conversion is over the predetermined value, the judgement is that the interior of the collecting container is not full of the toners, and the processing goes back to step S5, thus coming to the wait for print signal status.

Further, when A=1 in step S6, the processing proceeds to step S9. In step S9, A=1, i.e., this implies that the full storage was detected once in the past, and hence the user is prenotified of exchanging the process cartridge. The value B (i.e., the number of printable sheets in the process cartridge) on that occasion may be displayed for the user.

Next, in step S10, the print signal increments the value B by "1" at a time. In next step S11, the thus updated value B is compared with a predetermined value C, and a judgement is made in the same way as done in step S3. Herein, if the value B is over the value C, the full storage of this cartridge is already detected, and the number of prints thereafter reaches the predetermined number. Consequently, if more are printed than this, it implies such a possibility that the main body might be damaged to a critical degree. Hence, the processing proceeds to next step S12, wherein the latest values A and B in the memory within the process cartridge are updated. Then, the processing goes back to step S4 in order to stop the main body.

Incidentally, the processing may jump from step S11 over step S12 back to step S4. In this case, if the values A and B are written to the RAM in the cartridge before taking the cartridge out of the apparatus, this writing process may be executed at any timings. For instance, those values may be written just when ejecting the cartridge.

In step S11, if the value B is less than the value C, the main body does not suffer from the critical damage even when permitting the printing, and therefore the printing is permitted. In step S13, the latest values A and B in the memory within the process cartridge are updated, and the processing gets back to step S5, thus coming to the wait for print-signal status. Herein also, when B<C, the processing may jump over step S13 directly to the wait for print signal status. In this case, the latest values A and B are temporarily stored in the memory means in the main body of the apparatus, and may be written, e.g., just when opening the door for taking the cartridge out.

As discussed so far, in accordance with the first embodiment, the process cartridge 27 has the built-in memory 28 which stores the data A indicating whether the full storage was detected in the past by the main body, and the number of prints B printed after detecting the full storage, thereby enabling a more accurate detection of the full storage. Moreover, the main body of the image forming apparatus is capable of precisely informing the user of the number of residual printable sheets, and therefore the exchange cartridge can be efficiently prepared. Further, the toner collecting container is full of the toners, and a due number of sheets are printed after prenotification of the exchange, on which occasion the main body of the apparatus can be prevented from the critical damage by stopping the main body of the image forming apparatus.

Embodiment 2

Figure 4:
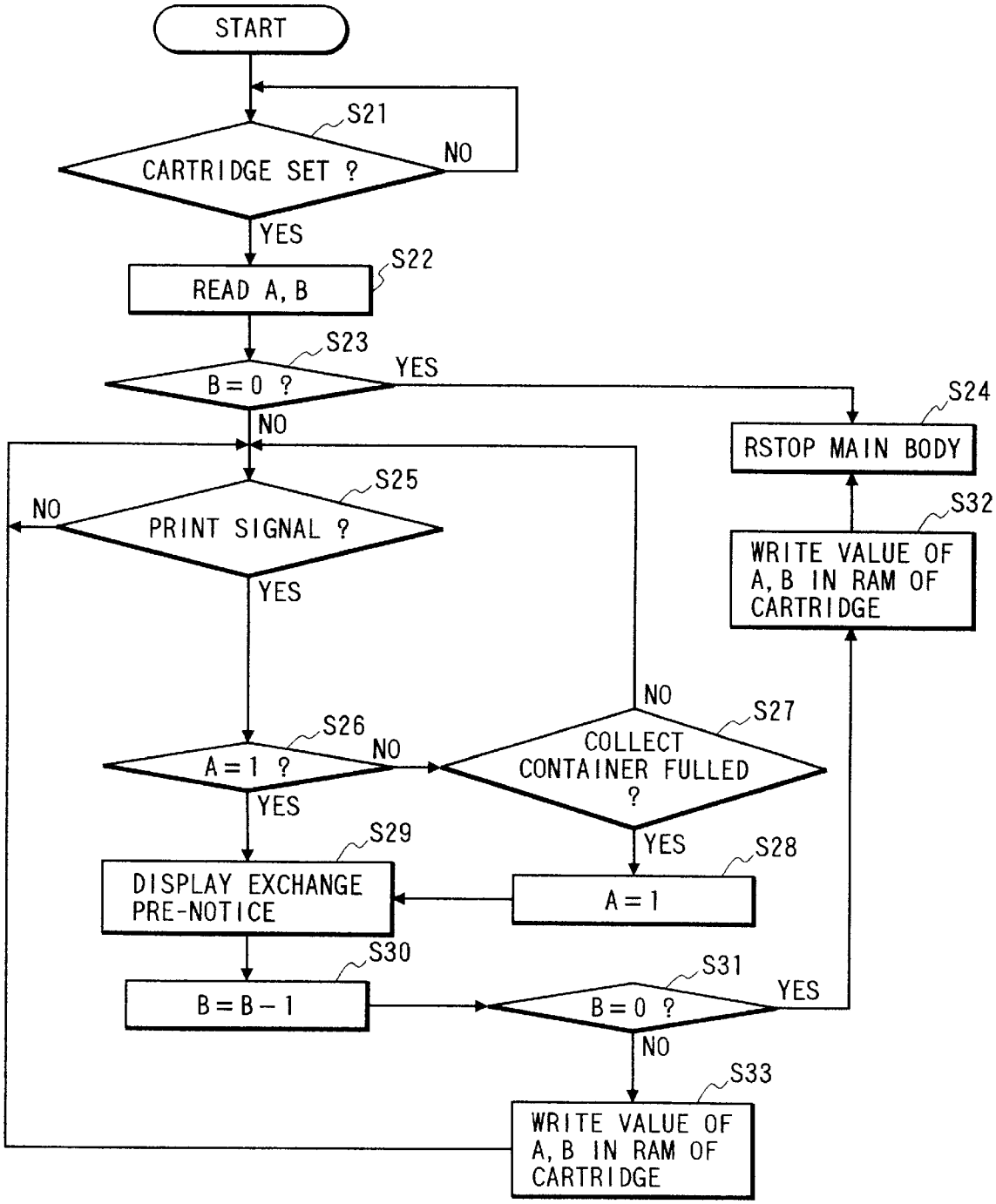
FIG. 4 is a flowchart showing procedures of detecting the life-span thereof in an embodiment 2.

An embodiment 2 of the present invention will hereinafter be described with reference to FIG. 4. The construction of the image forming apparatus and the image forming processes are, however, the same as those in the embodiment 1, and hence their explanations are omitted.

Hereinbelow, a description will be given with reference to a flowchart of FIG. 4 explanatory of the procedures of detecting a life-span in this embodiment.

It is checked in step S21 whether or not the process cartridge is correctly attached to the main body of the image forming apparatus. If the cartridge is attached thereto, the processing proceeds to step S22. Next in step S22, the CPU 22 of the main body has an access to the memory 28 incorporated into the process cartridge 27 via the connector 25.

In step S23, the memory 28 is stored with data A indicating whether or not the full storage of the present cartridge itself was detected in the past by the main body, and data B indicating the number of prints on which images can be formed till the cartridge is exchanged since the full storage was detected. In accordance with the second embodiment, the data A is 1-bit data and takes a value of "0" if the full storage was not detected in the past and a value of "1" if detected in the past. Further, herein the 1-bit data is used as the data indicating whether the full storage state is detected or not. Data of a plurality of bits may also be used for indicating detailed states of the full storage of the collecting container. The number of sheets B on which the images are form able till the cartridge is exchanged since the full storage was detected, is set to 300, and a new process cartridge 27 is stored with values of A=0 and B=300.

On the occasion of delivering it as a new product, the value B can be previously changed depending on a type of the cartridge. In this step S22, the CPU reads these pieces of data A and B.

In next step S23, whether the value B is "0" or not is judged. If the value B is "0", the full storage of this cartridge has already been detected, and the number of prints thereafter reaches a predetermined number. Therefore, if more are printed than this, it implies such a possibility that the main body might be damaged to a critical degree. Hence, the processing proceeds to next step S24 in order to stop the main body. After stopping the main body, the user may be informed of the fact that the number of prints in this cartridge exceeds the predetermined number by a sufficient margin to reach its life-span, and that the main body does not operate unless it is exchanged.

In step S23, if the value B is over "1", the main body does not yet suffer from the critical damage even when permitting the printing, and therefore the printing is allowed, thus coming to a wait for print signal status (step S25).

Next, when the print signal is turned ON, the main body of the image forming apparatus starts printing, and the processing goes forward to step S26. It is judged whether the data A indicating whether or not the full storage of the present cartridge itself was detected in the past by the main body, is "1" or not. If A=1, this purports that the full storage was detected in the past by the main body. If A=0, this purports that the full storage was not detected in the past by the main body. When A=0, the processing proceeds to step S27, wherein it is checked whether or not the collecting container is full of the toners. More specifically, the output voltage X of the light emitting element 30 stated above and the output voltage Y of the light receiving element 31, are inputted to the comparison calculator 20 in the main body, in which the values of two voltages are compared and calculated. An arithmetic result is digitized by the A/D converter 21 and thereafter taken in by the CPU 22.

The CPU 22 is capable of reading a value (Y/X) after the A/D conversion has been made. If the value given by Y/X is approximate to "1", there is no full storage. If approximate to "0", this implies that the light beams from the light emitting element do not sufficiently reach the light receiving element 31 because of the presence of the disposal toners, and it can be therefore regarded as being very close to the full storage. If the value (Y/X) after the A/D conversion is smaller than a predetermined value, it is judged that the full storage is attained, and the processing proceeds to step S28 in which to set the value A to "1". Thereafter, the processing goes forward to step S29. If the value (Y/X) after the A/D conversion is over the predetermined value, the judgment is that the interior of the collecting container is not full of the toners, and the processing goes back to step S25.

Now, when A=1 in step S26, the processing proceeds to step S29. In step S29, A=1, i.e., this implies that the full storage was detected once in the past, and hence the user is prenotified of exchanging the process cartridge. The value B (indicating i.e., how many sheets the process cartridge is capable of printing later on) on that occasion may be displayed for the user.

Next, the processing proceeds to step S30, the print signal decrements the value B by "1" at a time. Next, in step S31, the thus updated value B is compared to judge whether it is "0" or not in the same way as done in step S23.

Herein, if the value B is "0", the full storage of this cartridge has already been detected, and the number of prints thereafter reaches a predetermined number. Therefore, if more are printed than this, it implies such a possibility that the main body might be damaged to a critical degree. Hence, the processing proceeds to next step S32, wherein the latest values A and B in the memory within the process cartridge are updated, and the processing goes back to step S24 in order to stop the main body.

In step S31, if the value B is over "1", the main body has not yet suffered from the critical damage even when permitting the printing, and therefore the printing is allowed. In step S33, the latest values A and B in the memory within the process cartridge are updated, and the processing gets back to step S25, thus coming to a wait for print signal status. What has been so far described is a series of procedures of detecting the life-span in the second embodiment.

In the second embodiment, unlike the embodiment 1, the number of printable sheets after detecting the full storage can be set when delivered, and therefore, even if plural kinds of cartridges are prepared for the same main body, the main body can be stopped at the very limit of sheets just before critical damage occurs to the main body, depending on the kinds of the respective cartridges. It is consequently feasible to effectively utilize the cartridge to the end.

Embodiment 3

The embodiments 1 and 2 have dealt with the case where the present invention is applied to the mono color laser beam printer illustrated in FIG. 1. In accordance with a third embodiment, however, the present invention is applied to a full color laser beam printer using yellow, magenta, cyan and black, which is shown in FIGS. 5 and 6.

Figure 5:
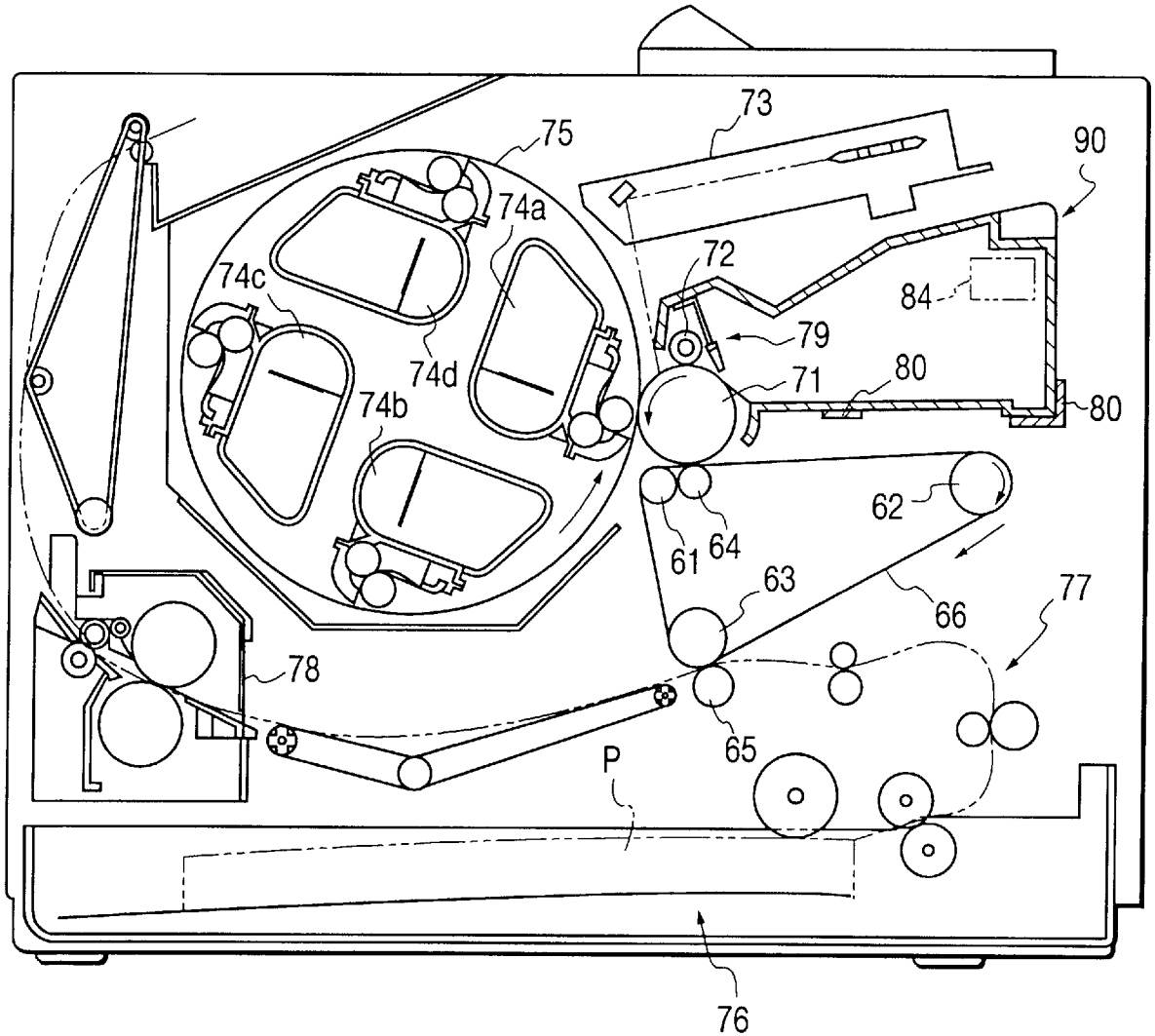
FIG. 5 is a view schematically showing a construction of an image forming apparatus in an embodiment 3.
Figure 6:
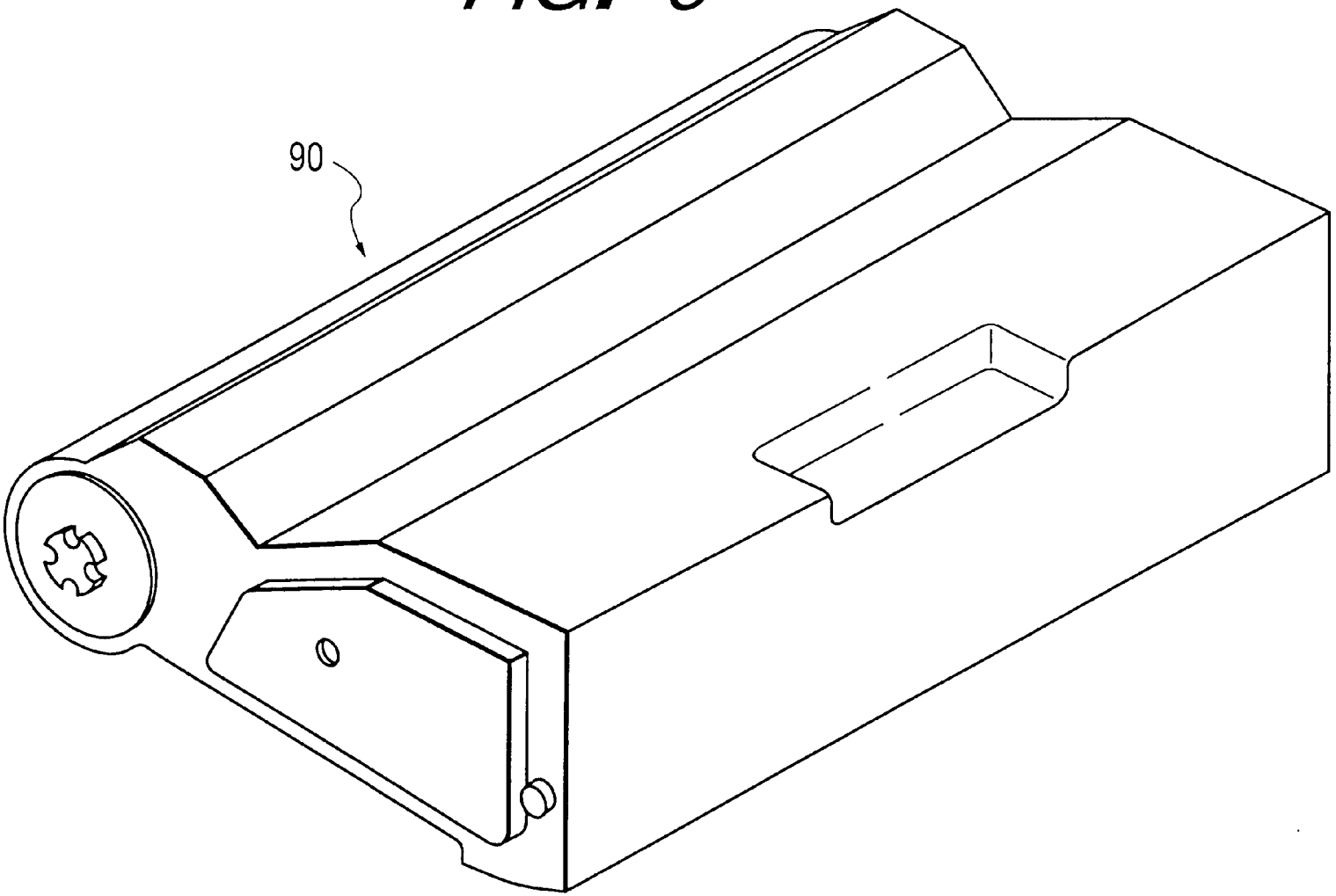
FIG. 6 is a view illustrating a construction of a process cartridge attached to the image forming apparatus shown in FIG. 5.

Referring first to FIG. 5, a photosensitive drum 71 is driven in an arrowed direction in FIG. 5 by a driving mechanism (not shown), and is charged uniformly at a predetermined electric potential by a roller charging device 72. Subsequently, an exposure device 73, to which signals corresponding to an image pattern in yellow are inputted, irradiates the photosensitive drum 71 with the leaser beams, thereby forming a latent image on the photosensitive drum 71.

When the photosensitive drum 71 further advances in the arrowed direction, a support member 75 is rotated so that, e.g., a developing device 74*a* stored with yellow toners amongst developing devices 74*a,* 74*b,* 74*c* and 74*d* supported on a support member 75, faces to the photosensitive drum 71. Then, the above latent image is made visible by the developing device 74*a*. Subsequently, a toner image developed is transferred onto an intermediate transfer belt 66 defined as an intermediate transfer body.

The intermediate transfer belt 66 is stretched between three lengths of support rollers 61, 62, 63, and moves in an arrowed direction in the Figure with rotations of the support roller 62 connected to a driving source (not shown). Further, a primary transfer roller 64 is provided at a portion facing the photosensitive drum inwardly of the intermediate transfer belt 66, and a high-voltage power supply (not shown) applies a predetermined bias thereto. The toners on the photosensitive drum 71 are thereby transferred onto the intermediate transfer belt 66.

The processes described above are further executed by the developing devices 74*b,* 74*c,* 74*d* in the order of, e.g., magenta, cyan and black, thereby forming toner images in four colors on the intermediate transfer belt 66. These four toner images are transferred en bloc by a secondary transfer roller 65 onto a transfer sheet carried through a convey mechanism 77 from a sheet feeding device 76, synchronizing with a movement of the intermediate transfer belt 66. Further, the transfer sheet is subjected to a fusion fixing process by a heating/pressurization fixing device 78, thereby obtaining a color image.

A cleaning device 79 including a blade member cleans the photosensitive drum 71 of transfer residual toners thereon.

Further, in accordance with the third embodiment, the charging roller 72, the photosensitive drum 71 and the cleaning device 79 are constructed into an integral process cartridge 90 bearing an external appearance as illustrated in FIG. 6. The process cartridge 90 is detachable from and attachable to the main body of the apparatus by an attaching guide member 80. Provided further is a memory means 84 functioning in the same way as the memory 28 in the embodiment described above.

Note that the developing devices 74*a* to 74*d* for four colors are also so constructed as to be detachable from and attachable to the main body of the apparatus as in the case of the process cartridge. The construction given above enables the user to easily implement the exchange and maintenance of the above member, which have hitherto been carried out by a service man.

The same operation and effect as those shown above can be obtained by applying the present invention discussed in the embodiments 1 and 2 to the full color image forming apparatus having the construction described above.

As obvious from the description given above, according to the present invention, it is feasible to accurately detect the life-span of the process cartridge from the quantity of the disposal toners and the number of remaining printable sheets even in the case of a misdetection due to the attaching/detaching process of the process cartridge and of its being attached to other main body of apparatus, and also to notify the user of the number of remaining printable sheets. Accordingly, it is possible to obtain the process cartridge enabling the efficient preparation for the exchange cartridge and the image forming apparatus containing this process cartridge while preventing an adverse influence on the output image as well as on the main body of the apparatus.

Further, when the toner collecting container becomes full of the toners, and in case a due number of sheets are printed after being notified of the exchange, it is feasible to prevent the main body of the apparatus from being damaged to the critical degree by stopping the main body of the apparatus.

Incidentally, the "process cartridge" involves a construction in which the charging device, the developing device or the cleaning device and the electrophotographic photosensitive body are integrally formed into a cartridge which is set detachable from and attachable to the main body of the electrophotographic image forming apparatus; or a construction in which at least one of the charging device, the developing device and the cleaning device, and the electrophotographic photosensitive body are integrally formed into a cartridge which is set detachable from and attachable to the main body of the electrophotographic image forming apparatus. It further involves a construction in which at least the developing device and the electrophotographic photosensitive body are integrally formed into a cartridge which is set detachable from and attachable to the main body of the electrophotographic image forming apparatus.

The present invention is not limited to the embodiments discussed above but may include modifications of the same technical concept.

What is claimed is:

1. An image forming apparatus comprising:

an image bearing member;

image forming means for forming a developing agent image on said image bearing member;

transferring means for transferring the developing agent image formed on said image bearing member onto a recording member;

cleaning means for cleaning said image bearing member;

a container for storing the developing agent removed from said image bearing member;

detecting means for detecting whether or not a quantity of the developing agent in said container has reached a predetermined state;

counting means for counting prints made;

storing means for storing a result of the detection made by said detecting means and a count value counted by said counting means after the quantity of the developing agent in said container has reached the predetermined state; and control means for controlling said image forming apparatus in accordance with the information stored in said storing means, wherein said container and said storing means are constructed into a unit which is detachable from and attachable to a main body of said apparatus.

2. The image forming apparatus according to claim 1, wherein said detecting means has a light emitting element and a light receiving element for receiving light beams emitted from said light emitting element, and said detecting means judges that the predetermined state is reached when the light beams emitted from the said light emitting element are intercepted by the developing agent within said container and is not substantially received by said light receiving element.

3. The image forming apparatus according to claim 1, wherein said unit further has at least one of said image bearing member, said image forming means and said cleaning means.

4. The image forming apparatus according to claim 1, wherein said control means outputs a signal to facilitate exchange of said unit when said detecting means detects the predetermined state.

5. The image forming apparatus according to claim 1, wherein said control means sets said image forming apparatus in a state of not accepting an input of a print signal when the count value reaches a predetermined value.

6. The image forming apparatus according to claim 1, wherein said storing means further stores a number of printable sheets after the quantity of developing agent within said container reaches the predetermined state.

7. The image forming apparatus according to claim 1, wherein said storing means is a semiconductor storage element.

8. The image forming apparatus according to claim 7, wherein said semiconductor storage element is a non-volatile RAM.

9. The image forming apparatus according to claim 1, wherein said image bearing member is a electrophotographic photosensitive member.

10. A cartridge attachable to an image forming apparatus for forming an image of developing agent on an image bearing member, transferring the developing agent image onto a recording member and thus forming an image on the recording member, said cartridge comprising:

a container for storing the developing agent collected from said image bearing member; and storing means for storing information for judging whether or not a quantity of developing agent within said container has reached a predetermined state, and a number of prints made after the quantity of developing agent within said container has reached the predetermined state.

11. The cartridge according to claim 10, wherein said storing means further stores a number of printable sheets after the quantity of developing agent within said container reaches the predetermined state.

12. The cartridge according to claim 10, wherein said storing means is a semiconductor storage element.

13. The cartridge according to claim 12, wherein said semiconductor storage element is a non-volatile RAM.

14. The cartridge according to claim 10, wherein said image bearing member is a electrophotographic photosensitive member.

15. A cartridge according to claim 10, further comprising at least one of said image bearing member, charging means for charging said image bearing member, developing means for supplying said image bearing member with the developing agent, and cleaning means for cleaning said image bearing member.

* * * * *

UNITED STATES PATENT AND TRADEMARK OFFICE

CERTIFICATE OF CORRECTION

PATENT NO. : 5,956,541

DATED : September 21, 1999

INVENTOR(S) : NORIHISA HOSHIKA et al.

It is certified that error appears in the above-identified patent and that said Letters Patent is hereby corrected as shown below:

Title page, item [56],
REFERENCES CITED:

U.S. PATENT DOCUMENTS, insert --5,822,646 10/1998 Kinoshita et al.--.

COLUMN 1:

Line 14, "therein" should read --wherein--.

COLUMN 7:

Line 37, "form able" should read --formable--.

Signed and Sealed this

Tenth Day of April, 2001

Nicholas P. Godici

*Attest:*

NICHOLAS P. GODICI

*Attesting Officer*

*Acting Director of the United States Patent and Trademark Office*